United States Patent [19]

Anderson

[11] 4,032,312

[45] June 28, 1977

[54] CENTRIFUGAL COMPRESSOR

[75] Inventor: Carl M. Anderson, Syracuse, N.Y.

[73] Assignee: Carrier Corporation, Syracuse, N.Y.

[22] Filed: Apr. 16, 1976

[21] Appl. No.: 677,584

[52] U.S. Cl. ..... 62/498; 415/112

[51] Int. Cl.[2] ..... F25B 1/00; F01D 11/00; F01D 25/16; F03B 11/00

[58] Field of Search ..... 417/174; 415/122 R, 415/168, 112; 62/498

[56] References Cited

UNITED STATES PATENTS

| | | | |
|---|---|---|---|
| 1,737,870 | 12/1929 | Telfer | 415/112 |
| 2,575,923 | 11/1951 | McMahan et al. | 415/112 |
| 3,574,478 | 4/1971 | Toth, Jr. | 415/112 |

*Primary Examiner*—Lloyd L. King

*Attorney, Agent, or Firm*—J. Raymond Curtin; Donald F. Daley

[57] ABSTRACT

Apparatus for reducing windage and pumping losses in the transmission section of a centrifugal compressor by reducing the density of the atmosphere in which the transmission gear mechanism operates.

7 Claims, 2 Drawing Figures

CENTRIFUGAL COMPRESSOR

BACKGROUND OF THE INVENTION

This invention relates to means for reducing the power consumed in a refrigeration system employing a centrifugal compressor.

In many centrifugal compressors, both the impeller section and the transmission section of the compressor are contained within a single hermetically sealed housing and the two sections interrelated by an impeller drive shaft passing through a wall separating the two sections. Positive and complete sealing of the shaft opening in the wall is never realized in practice. Recognizing that leakage will occur, it is common practice to control the direction of leakage so as to insure that refrigerant will flow into the transmission section rather than oil flowing into the impeller section.

To achieve this result, the transmission chamber is typically vented directly to the evaporator of the refrigeration system thereby placing the transmission at some pressure close to the compressor inlet pressure. The higher pressure generated in the impeller section tends to move refrigerant through the impeller shaft opening into the transmission section thus preventing oil from moving in the opposite direction. The gears of the transmission are thus required to operate in a relatively dense atmosphere of refrigerant vapor. Although gear designs can be optimized to minimize system losses, little can be done, in a mechanical sense, to reduce windage and pumping losses produced by operating in a heavy or dense atmosphere.

SUMMARY OF THE INVENTION

It is an object of the present invention to improve the efficiency of refrigeration systems employing centrifugal compressors.

A further object of the present invention is to reduce windage and pumping losses within the compressor transmission section of a centrifugal compressor.

These and other objects of the present invention are attained in a vapor compression system for processing refrigerants having a hermetically sealed centrifugal compressor consisting of an impeller section and a transmission section, including means to isolate refrigerant vapor from the oil contained within the transmission section and pump means to draw the isolated refrigerant from the transmission section thereby reducing the density of the atmosphere in which the transmission gear mechanism operates.

BRIEF DESCRIPTION OF THE DRAWINGS

For a better understanding of the present invention, as well as other objects and further features thereof, reference is had to the following detailed description of the invention to be read in connection with the accompanying drawings, wherein.

DESCRIPTION OF THE PREFERRED EMBODIMENT

Figure 1:
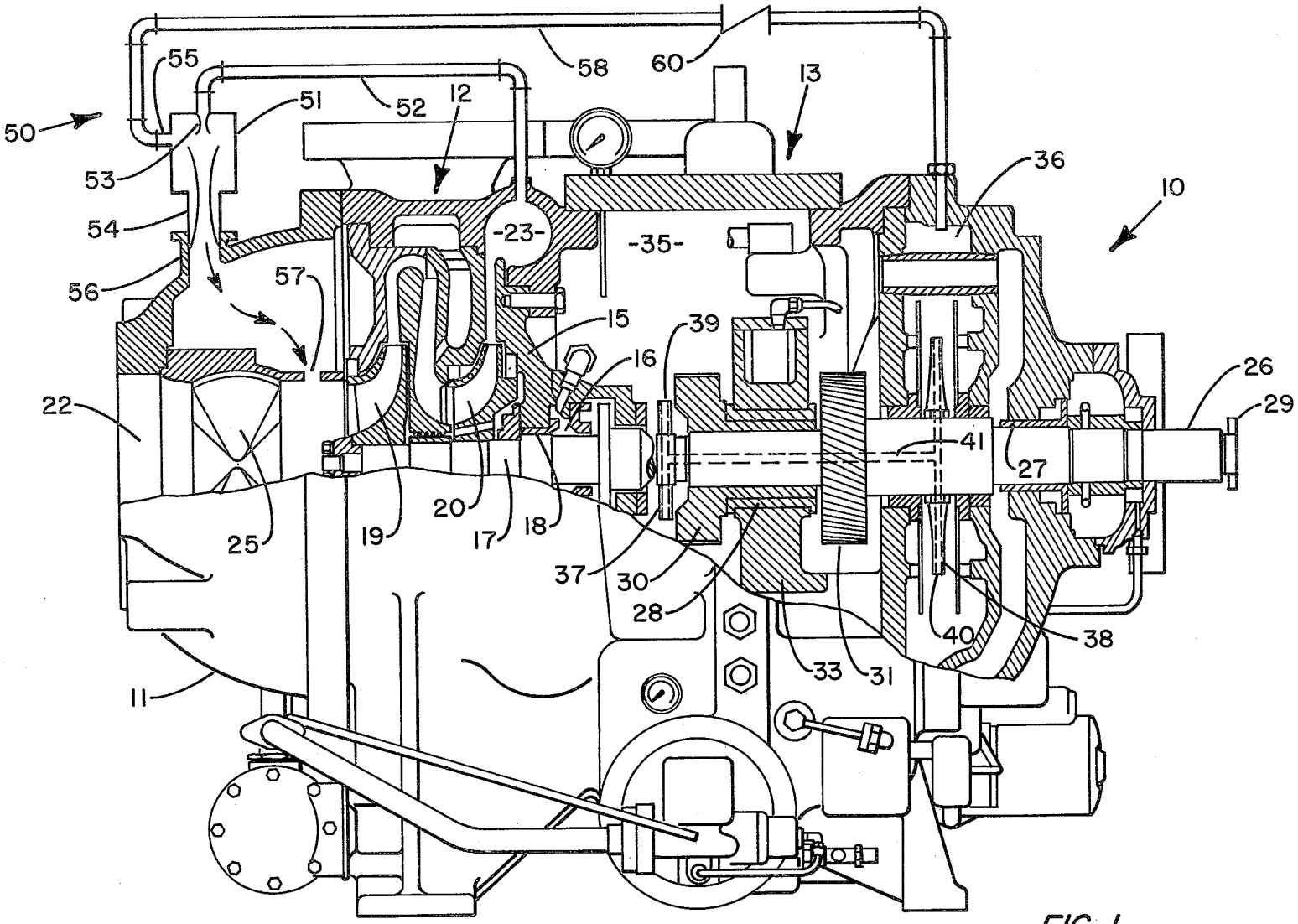
FIG. 1 is a sectional view of a centrifugal compressor showing an impeller shaft extending from the compressor impeller section into the compressor transmission section and further illustrating apparatus for reducing windage and pumping losses within the transmission section in accordance with the teachings of the present invention.

Referring now to FIG. 1, there is shown a centrifugal compressor 10 as typically employed in a vapor compression refrigeration system. The compressor is of conventional construction depicting a hermetically sealed housing 11 which is separated into two sections, a first impeller section 12, and a second transmission section 13, separated by a commonly shared wall 15. An opening 16 is provided within the wall through which passes an impeller shaft 17, the shaft being rotatably supported in the opening by bearing 18. Although not shown, shaft seals, as typically employed in the art, are also provided which serve to limit or minimize the flow of fluids or vapors through the shaft opening formed in wall 15.

The compressor contains two stages of compression generated by a first stage impeller 19 and a second stage impeller 20, both of which are secured for rotation upon impeller shaft 17 within the impeller section of housing 11. Refrigerant enters the compressor via inlets 22, passes through the two impellers, and is discharged into a discharge volute 23 from which it passes into the condenser (not shown) of the refrigeration system. A series of controllable guide vanes 25 is positioned within the inlet to the compressor which serves to regulate the flow of refrigerant from the system evaporator to the first stage of compression.

In the transmission section 13, is located a second drive shaft 26, rotatably supported between bearings 27, 28, which is horizontally aligned with the impeller shaft 17. One end of the drive shaft, the right-hand end, as viewed in FIG. 1, extends outwardly from the compressor housing and terminates in a coupling 29 suitable for joining the shaft to a drive means, such as an electric motor or the like. A pair of drive gears 30, 31 is secured to the drive shaft on either side of bearing block 33. The drive gears are arranged to mate with a pair of pinions (not shown) secured to the impeller shaft within the transmission section. A supply of oil is contained within a reservoir located in the bottom of the transmission section and, as well known in the art, the oil pumped to the bearing and gears to lubricate the system.

As will be described in greater detail below, the main chamber 35 of the compressor transmission section, which faces the impeller section, is held at a considerably lower pressure than that maintained in the impeller section. As a consequence, refrigerant, generally in a vapor state, is forced past the shaft seals from the impeller section into the transmission section. Although, for obvious reasons, the amount of leakage is held to a minimum, sufficient vapor is eventually exchanged so that an extremely dense atmosphere is created within the transmission section in which the gears must operate.

In the present apparatus, refrigerant vapor is physically drawn from the main transmission chamber 35 and temporarily stored within a secondary chamber 36 adjacent thereto by means of a device generally referred to as a demistor. The demistor is made up of two wheel-like elements consisting of spokes 37, 38 extending outwardly from the shaft 26 in a radial direction with the spokes 37 of the first wheel being positioned in the main chamber 35 of the transmission, and the spokes 38 being positioned in secondary chamber 36. Passage 39, 40 are radially passed through spokes 37,

38, respectively, into the shaft structure, as illustrated in FIG. 1. The passages are placed in fluid flow communication via an axially aligned opening 41 formed in the shaft. The radial length of spokes 37, and thus the length of the passages passing therethough, in the main chamber 35 are less than those positioned within the secondary chamber 36. As the shaft is turned at operational speeds, centrifugal forces of different magnitudes are created in each wheel, producing a differential in pressure over the entire system which is sufficient to draw vapors from the main chamber into the secondary chamber. Heavier oil droplets which might be suspended in the vapors contained in the main chamber are thrown off by the rapidly rotating wheel and are thus prevented from entering the secondary chamber. Consequently, the demistor functions to separate the vapor from the oil contained in the transmission and isolate the separated vapor in a capture chamber.

A pumping network, generally referenced 50, is herein provided to evacuate the transmission section of the compressor. As is well known, the density of a vapor is directly proportional to its pressure or partial pressure. By pumping down the transmission section, and thus reducing the pressure of the refrigerant vapor contained therein, the density of the atmosphere in which the gear network operates can be considerably reduced. As a result, the pumping and windage losses generated in the transmission section are similarly reduced. In a test conducted upon a compressor of the type herein described, the tranmission section was pumped down from a normal operating pressure of about 60 psia to about 16 psia which resulted in reduction in horsepower consumed by the compressor drive from 160 to 95 horsepower.

Referring once again to FIG. 1, the pumping network includes a jet pump or ejector 51, operatively connected to the discharge volute 23 of the compressor via inlet line 52. In operation, a small portion of the high pressure refrigerant passing through the volute is delivered by line 52 into a nozzle 53 positioned within the ejector pump which serves to increase the velocity of the motive fluid. The motive fluid issuing from the nozzle is directed into a discharge line 54, as shown, thus creating a suction pressure at the suction inlet 55 of the pump.

The discharge line 54 of the ejector is placed in fluid flow communication with the inlet to the compressor by means of connector 56 and opening 57 formed in the compressor inlet tube directly behind guide vanes 25.

The suction inlet 55 to the ejector pump is operatively connected to the secondary chamber 36 of the transmission, in which is stored separated or oil-free refrigerant vapor, by means of suction line 58. Under the influence of the suction generated by the high speed motive fluid passing through the pump, oil-free refrigerant vapor is drawn from chamber 36 and is entrained within the motive fluid which is ultimately returned to the compressor inlet. It should be noted that the main chamber of the transmission is also operatively connected to the pump through the demistor system so that as the pressure in the secondary chamber is being reduced, the pressure in the main chamber is similarly being reduced. The pumping down of the main chamber through the demistor, while having no adverse effects on the operation thereof, provides a convenient means for removing oil-free refrigerant from the transmission.

A swing or check valve 60 is operatively placed within the suction line to permit refrigerant to flow in the direction of the ejector pump, but prevent the flow from moving in the opposite direction.

It should be noted that the pumping network, utilizing a jet pump in the manner herein disclosed, provides a compact self-contained unit for continually maintaining the pressure within the transmission section at a relatively low pressure, that is, at a pressure considerably below that maintained in most conventional systems. In order to preserve the integrity of the hermetically sealed compressor housing, it is preferable to regulate the operation of the system so as to maintain the transmission pressure slightly above atmospheric pressure. It should be further noted that by utilizing refrigerant vapors as the motive fluid in the present evacuation system, the pump discharge contains only refrigerant and can thus be directed back into the refrigeration system eliminating the need for special handling equipment, or the like. Similarly, the present system cannot deplete the refrigeration system of refrigerant.

Figure 2:
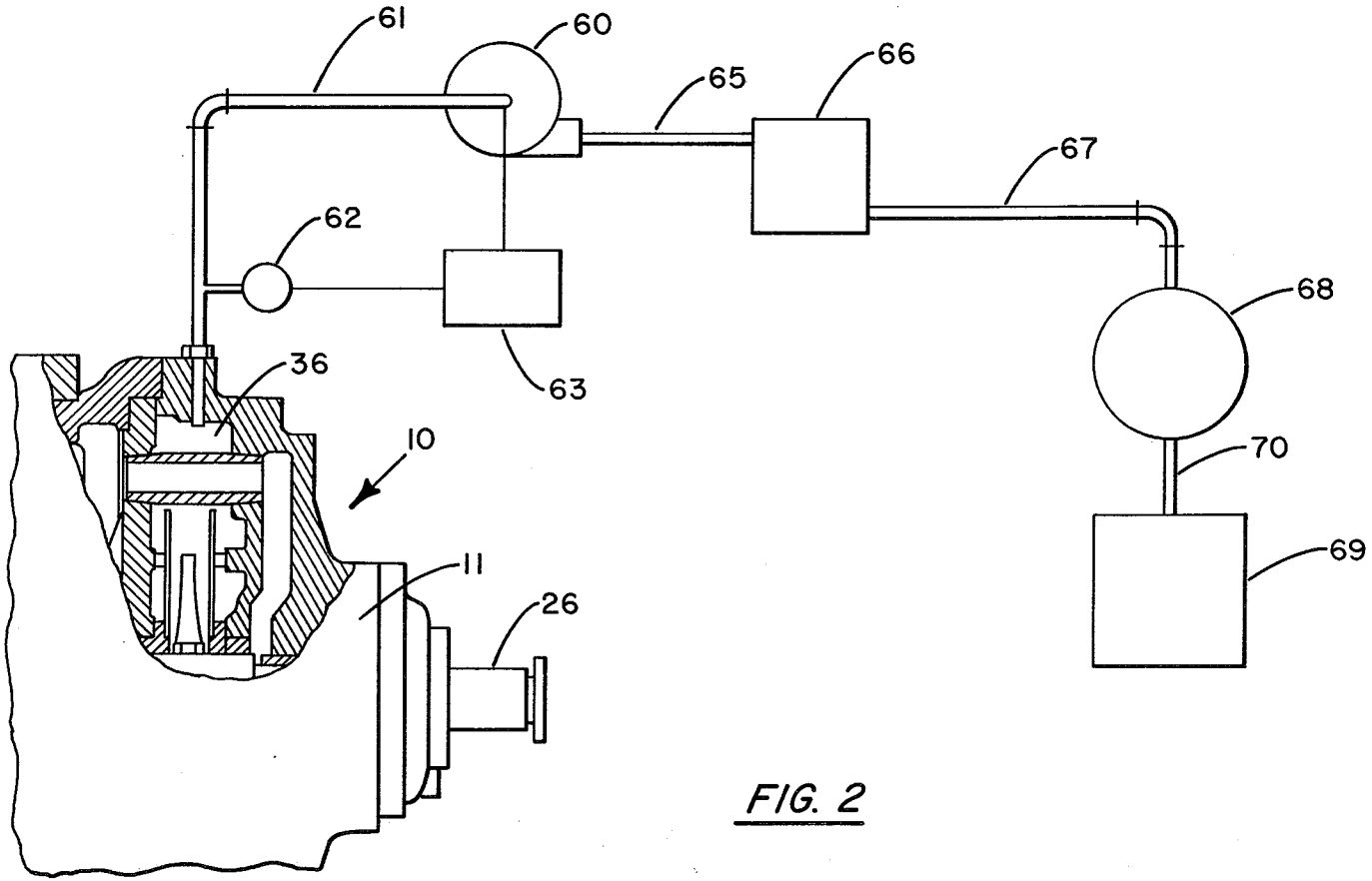
FIG. 2 is a partial view of a centrifugal compressor, similar to that shown in FIG. 1, further illustrating a second embodiment of the present invention.

Referring now to FIG. 2, there is shown a second embodiment of the present invention utilizing a conventional mechanical pump in place of the ejector previously described. As illustrated, the suction side of the pump 60 is connected to the chamber 36 of the transmission section of compressor 10 via a suction line 61. Under the influence of the pump, the transmission section is evacuated to reduce the pressure therein. As noted, it is preferable to maintain the pressure within the transmission at some predetermined pressure slightly above atmospheric. To this end, a pressure sensor 62 is operatively positioned within the suction line and adapted to send a pressure indicative signal to regulator 63. The regulator, in turn, is arranged to control the operation of the pump so as to maintain the suction pressure at a desired predetermined level.

In the present embodiment, the discharge of the pump is delivered via line 65 into an oil separator 66. The oil separator, which can be of a typical construction known and used in the art, isolates refrigerant vapor from any oil which might be entrained therein and passes the vapor through line 57 directly to a condenser 58 where the vapor is brought to a liquid state. Finally, the liquid refrigerant is discharged from the condenser into a holding or storage tank 69 via line 70 from where it can be claimed once again for use in the refrigeration system.

While this invention has been described with reference to the structure herein disclosed, it is not confined to the details as set forth, and this application is intended to cover any modifications or changes as may come within the scope of the following claims.

What is claimed is:

1. In a centrifugal compressor, as employed in a refrigeration system, of the type having a hermetically sealed housing containing an impeller section and a transmission section separated by a wall through which passes the impeller shaft, the improvement comprising separator means for isolating refrigerant vapor contained within the transmission section, and pump means operatively connected to the transmission section and being arranged to draw the isolated refrigerant vapor from the transmission whereby the pressure of the atmosphere contained within the transmission section is substantially reduced.

2. The improvement of claim 1 wherein said pump is a jet pump having a nozzle operatively connected to the refrigerant discharge of the impeller section whereby a portion of the refrigerant processed in the compressor is used as a motive fluid in said jet pump.

3. The improvement of claim 2 wherein the discharge of said jet pump is operatively connected to the suction inlet of said compressor whereby refrigerant passing through the pump is returned to the refrigeration system.

4. The improvement of claim 3 wherein the jet pump is arranged to maintain the pressure within the transmission section at above atmospheric pressure and substantially below the compressor suction pressure when the compressor is in operation.

5. In a centrifugal compressor, as utilized in a refrigeration system, of the type having a hermetically sealed housing containing an impeller section and a transmission section that are separated by a wall through which passes an impeller shaft, the improvement comprising a pump, the suction side of which is operatively associated with the transmission section, for evacuating the atmosphere contained within the transmission section whereby the pressure, and thus the density, of the atmosphere in which the transmission gears operate is reduced substantially below the suction pressure of the compressor, a separator means operatively associated with the discharge of said pump being adapted to remove refrigerant vapor from the discharge of the pump, and condenser means operatively associated with the separator means for reducing the separator refrigerant vapors to a liquid state.

6. The improvements of claim 5 further including pressure sensing means for determining pressure in the transmission section, and control means operatively associated with said pressure sensing means for regulating the operation of said pump to maintain the pressure within the transmission at a predetermined level.

7. The improvement of claim 6 wherein the pressure in the transmission is maintained at above atmospheric pressure but below the compressor suction pressure.

* * * * *